United States Patent [19]

Van Hout et al.

[11] Patent Number: 4,955,473

[45] Date of Patent: Sep. 11, 1990

[54] PROTECTIVE ENCLOSURE FOR FLETCHING ON ARROWS

[76] Inventors: James E. Van Hout, 676 Briarvale Dr., Auburn Hills, Mich. 48057; John M. Van Hout, 1425 W. South Blvd., Troy, Mich. 48098

[21] Appl. No.: 409,817

[22] Filed: Sep. 20, 1989

[51] Int. Cl.[5] ..... F41B 5/06; B65D 85/00

[52] U.S. Cl. ..... 206/315.11; 224/916

[58] Field of Search ..... 124/23 A, 24 A, 41 R; 273/416, 423; 206/315.11; 224/916

[56] References Cited

U.S. PATENT DOCUMENTS 2,722,958 11/1955 King et al. ..... 224/916 X
2,768,669 10/1956 Kinnee ..... 224/916 X
3,465,928 9/1969 Osterholm ..... 224/916 X
3,766,954 10/1973 Gentellalli ..... 224/916 X
4,785,934 11/1988 Hogle ..... 224/916 X

*Primary Examiner*—Randolph A. Reese
*Assistant Examiner*—Jeffrey L. Thompson

[57] ABSTRACT

A protective device for an arrow fletching comprising an elongated enclosure having front and rear members. The front member is provided with an opening for the arrow shaft and slot like extensions for the arrow fletching. The rear member is provided with a chamber or web for attaching the arrow to the enclosure and for holding the arrow fletching in alignment with the extensions in the front member. Bands, rings and clips are also disclosed for attaching a plurality of the devices together.

18 Claims, 3 Drawing Sheets

PROTECTIVE ENCLOSURE FOR FLETCHING ON ARROWS

BACKGROUND OF THE INVENTION

The present invention relates to archery equipment and in particular to an accessory which enhances the convenience of arrow storage and transportation.

DESCRIPTION OF PRIOR ART

It is well known in the sport of archery that an archer's goal is to shoot arrows in straight flight and to hit targets with accuracy and repeatability. To help guide the arrows in straight flight, fletching is attached near the rearward end of the arrow. In the beginning of the sport of archery, feathers were affixed to the shafts of arrows to form fletching. Over the course of time many materials have been used, these materials include fabric, paper, and today's preferred choice—plastic.

Irrespective of the material used, fletching is very thin in structure. This thinness is due to a need for arrows to have very little aerodynamic drag. It is due to this thinness that fletching is usually not rigid, but rather, it is supple and flexible. This flexibility of the fletching is what makes it susceptible to damage which can occur during storage and transportation of the arrow.

During storage and transportation, fletching should not be put into a stressed state. Forces caused by contacting any other physical structure often cause deflection of the fletching from it's intended shape or position. If deflection does occur and is sustained over a period of time, even as low as a few hours, permanent set deformation can occur.

Plastic fletching is particularly susceptible to permanent set deformation due to cold flow, material creep, and stress relaxation.

Presently, a small percentage of archers store their arrows within an arrow case. In such a storage case, the arrows are securely fastened and mounted within the case in an arrangement such that the fletchings of the arrows are contacted only by air within the case.

A drawback of this storage and transportation method is the relatively large size and high cost of this special case storage means. An arrow case is an item that is generally not obtained by the majority of archers due to the prohibitive expense of the item. Also, the large size of an arrow case is considered to be a significant inconvenience for many households which have limited storage space. This limited storage space is also a very major concern when considering transportation of an arrow case via a modern downsized vehicle. Another additional factor to be considered is that many archers purchase arrows by the dozens. A reason that many archers prefer to purchase arrows in these quantities is for reasons of reduced cost due to quantity discount, arrow to arrow consistency, and increased convenience of one step shopping for an item that requires frequent replacement due to frequent loss or damage of arrows while practicing archery. This desire for a multiplicity of spare arrows creates a need for multiple storage cases, which compounds the above mentioned drawbacks of high cost and large size of arrow cases.

Due to these drawbacks of excessive size and high cost of storage cases, a common storage alternative is to carefully support the arrows so that the fletching is contacted only by air. Many times, however, during storage or during transportation of arrows to the archery range or to the field, the arrow positions are inadvertently disturbed and the fletching bears against a physical structure of another physical entity which causes deformation of the fletching. This deformation often results in permanent deformation of the fletching due to cold flow, creep, and stress relaxation.

Another common storage method is to position the arrows together with the fletchings bearing against one another, as in a cardboard storage tube, a long box, an open quiver, or in a bundle. In this arrangement, the fletchings of the arrows do get damaged, however the archer chooses to accept the damaged condition and resulting inaccurate arrow flight, or the archer is totally unaware that the damage is occurring, or has occurred.

A search was conducted in an attempt to obtain a storage and transportation device that will protect the fletching of an arrow, be convenient to use, and also have both a low cost and a small size. No conventional method was discovered, however the failure of this search resulted in the development of the following invention.

SUMMARY OF THE INVENTION

The present invention is concerned with an apparatus for protecting the fletching of an arrow during storage and transportation of the arrow. In this embodiment, the fletching is protected by a housing structure which attaches to the arrow and encompasses the fletching. The housing structure is an enclosure with sufficient length to cover the entire length of the fletching and is of sufficient breadth and cross sectional geometry to enclose the fletching, without touching the fletching when the axis of the arrow is centered within the enclosure.

The enclosure is provided with two end walls or end caps. Each end wall has a different shaped opening in it. The front wall opening has a pattern which allows various features of an arrow to pass through it. These features are an arrow nock, an arrow shaft, and the arrow fletching. This front wall opening pattern also allows edges of the front wall opening to bear against the shaft of the arrow. In this manner the forward part of the housing is substantially centered on the axial centerline of the arrow and is supported by the shaft of the arrow. The rear wall has an opening pattern which allows the nock of an arrow to clip to a web of material formed at the center of the rear wall. This clipping action is similar to how the nock of an arrow grips, or clips to a bowstring. When the housing is thus clipped to the nock of an arrow it is fixed in position with respect to the arrow, and the fletching is protected within the structural housing.

An alternate method for attaching the arrow nock to the rear wall is to form a receiving chamber at the center of the rear wall. The arrow nock is pressed into the chamber and held in by frictional forces of the chamber wall against the arrow nock.

These protective enclosure devices are cost efficient to manufacture, convenient and easy to use, and require far less storage space than conventional storage techniques. These advantages will be useful to both the individual archer and to shippers and handlers of archery equipment such as manufacturers, distributors and retailers.

BRIEF DESCRIPTION OF DRAWING FIGURES

DESCRIPTION OF A PREFERRED EMBODIMENT

Figure 1:
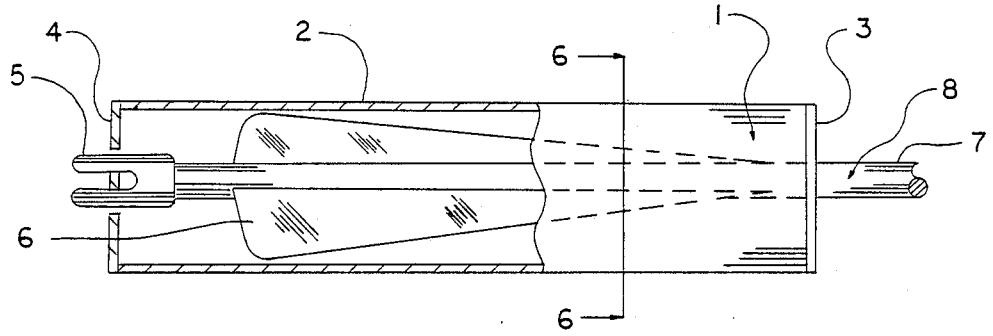
FIG. 1 is a side view with a partially cut away elevation, of the protective enclosure assembly with an arrow attached, showing the arrow nock engaging the rear wall and the front wall centering the arrow shaft within the housing.
Figure 2:
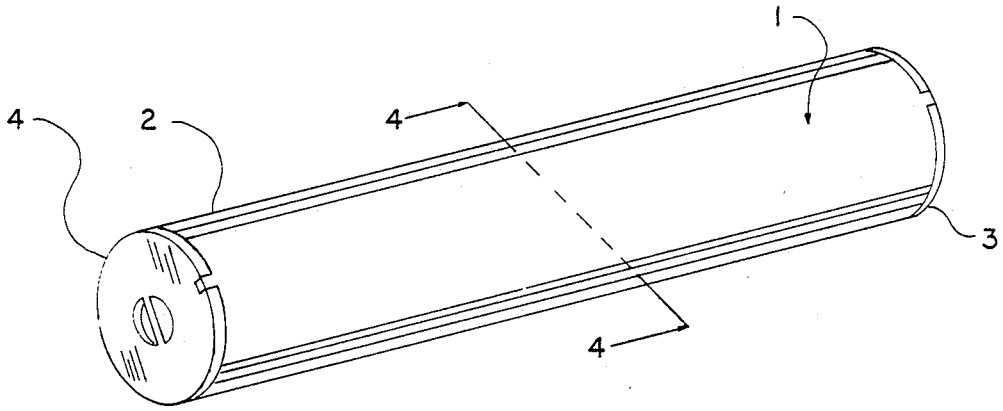
FIG. 2 is a perspective view of the protective enclosure assembly.

Referring now to FIGS. 1 through 14 of the drawings, there is shown in FIG. 1 an arrow 8 attached to a protective enclosure assembly 1. The protective enclosure assembly 1 as shown in FIG. 2 has a rear wall 4, and a front wall 3, also shown respectively in FIG. 3 and FIG. 4.

The front wall 3, and the rear wall 4 are attached to the forward and rearward ends of the housing 2 to form the protective enclosure assembly 1. The protective enclosure assembly 1 is made of material that has sufficient strength and stiffness to withstand any reasonable forces encountered during storage and transportation of arrows. One material example out of a variety of many suitable materials is a plastic molding material called polycarbonate.

Figure 4:
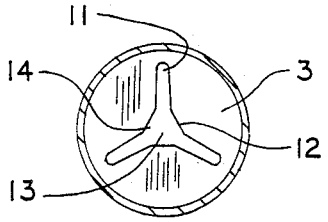
FIG. 4 is a section taken along 4—4 of FIG. 2 showing both the enclosure and the front wall and is illustrative of the geometric shaped opening feature in the front wall.
Figure 6:
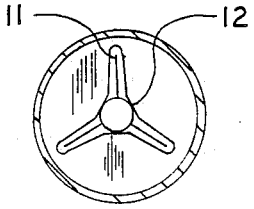
FIG. 6 is a section taken along 6—6 of FIG. 1 illustrative of an arrow shaft and fletching centrally positioned within the protective enclosure assembly.

The front wall 3 is shaped to fit and attach to the housing 2. A geometric shaped opening 14 of FIG. 4, is provided to allow an arrow nock 5, an arrow fletching 6, and an arrow shaft 7 of FIG. 1 to pass through during installation of the arrow 8 into the protective enclosure assembly 1. A multiplicity of radial slots 11 of FIG. 4 provide clearance for the arrow fletching 6 to pass through, while a center area 13 of the opening provides a passage for the arrow nock 5 and the arrow shaft 7 to pass through. Several contact points 12 are located near the inboard end of each slot 11 as shown in FIG. 6. These contact points 12, bear against the arrow shaft 7 when the protective enclosure assembly 1 is attached to the arrow 8. These contact points 12 are sized and positioned to allow either a slight clearance or a slight interference fit to the arrow shaft 7. These contact points 12 also position the arrow 8 centrally within the protective enclosure assembly 1 in such a manner as to never allow the fletching 6 to contact the inside of the housing 2.

Figure 7:
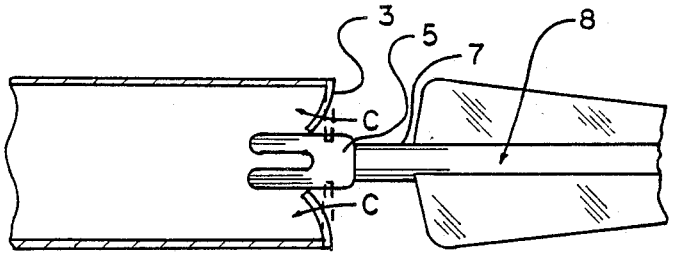
FIG. 7 is a partial cross sectional view of the enclosure assembly as an arrow flexes the front wall as it is being inserted through the opening in the front wall.
Figure 8:
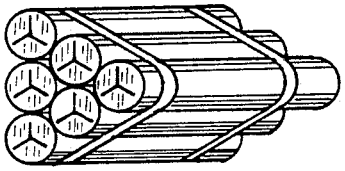
FIG. 8 is a view of a group of enclosure assemblies interconnected with two bands.

The front wall 3 as shown in FIG. 7 is formed of a resilient and flexible material designed to have forward and rearward flex "C" to allow the arrow nock 5, which has a larger diameter than the arrow shaft 7, to pass through the opening 14. The front wall 3 flexes rearward as the nock 5 of the arrow 8 is being pushed through the opening and then after the arrow nock 5 has passed through the opening, the wall 3 returns substantially to it's original position.

Figure 14:
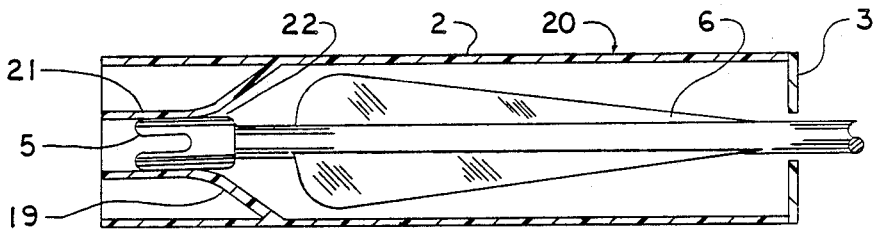
FIG. 14 is a cross sectional view of an alternate rear wall structure showing a receiving chamber for an arrow nock.

Two different rear wall to arrow nock 5 attachments can be utilized as shown in FIG. 1 and FIG. 14. The rear wall 4 of FIG. 1 uses a clip on method while the rear wall 19 of FIG. 14 uses a press fit method. Both of these rear wall designs are feasible. The following paragraphs will provide a further description of each design.

Figure 3:
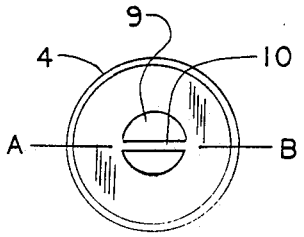
FIG. 3 is an end view of the enclosure assembly illustrative of the geometric shaped opening feature in the fear wall.
Figure 5:
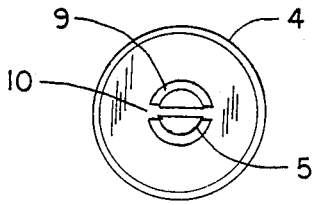
FIG. 5 is an end view of the enclosure assembly illustrative of the arrow nock clipped onto the central web of the rear wall.

The rear wall 4 of FIG. 3 is shaped to fit and attach to the housing 2. Two geometric shaped openings 9 provide clearance for the outside diameter of the arrow nock 5 to pass through, while a central web 10, between points "A" and "B" is provided for the inner surfaces of the arrow nock 5 to grip, or clip upon, similar to how an arrow nock is "nocked" or clipped onto a bow string. FIG. 5 shows the arrow nock 5 clipped into position on the rear wall web 10. The two geometric shaped openings 9 can be formed by various different shapes. The essential characteristics of the two openings is that in between the two openings, a web 10 is formed at the center of the rear wall 4. The web 10 must have sufficient length and width to allow an arrow nock 5 to clip upon it. The openings 9 must also provide clearance for the outside diameter of the arrow nock 5 and the sides of the opening must also laterally position the arrow nock 5 on the web 10 in such a manner as to assure that the arrow fletching 6 can not contact the inside of the enclosure assembly 1.

An alternative to the clip on protective enclosure assembly design, herein disclosed, is a similar protective enclosure assembly design 20 with a different means for attaching the arrow nock 5 to the rear wall 19, as shown in FIG. 14. The front wall 3 and the housing 2 function exactly as previously described and shown in FIG. 1, while the design of the rear wall 19 is altered to function as a receiving chamber which press fits over the arrow nock 5. This alternate method for attaching the arrow nock 5 to the rear wall 19 is shown in FIG. 14. The outer diameter of the arrow nock 5 is inserted into the inner diameter of the receiving chamber 21. The receiving chamber 21 is made of a resilient material such as PVC plastic and is sized such that it's inner diameter is slightly smaller than the outer diameter of the arrow nock 5. The resulting interference fit requires a nominal axial force to be applied to the arrow shaft 7 in order to press the arrow nock 5 into the receiving chamber 21. This press fit attachment method is similar to how a plastic cap is attached to a pen.

A funnelling feature can also be formed by the rear wall 19. The funnel shaped rear wall 19 guides the arrow nock 5 into the receiving chamber 21. A lead in chamfer 22 at the front of the receiving chamber 21 also facilitates insertion of the arrow nock 5 into the receiving chamber 21. When the arrow nock 5 is seated within the receiving chamber 21, the arrow 8 and it's fletching 6 are centered within the protective enclosure assembly 20 and thus, the fletching 6 is protected from damage.

Many fabrication techniques can be utilized in construction of these archery devices. The front wall 3 and the rear walls 4 and 19 of FIG. 1 and FIG. 14 can be attached to the housing 2 by various attachment means which include bonding, welding, fastening, and various other methods. The bonding process may include adhesive, solvent or other bonding techniques. The welding process may include frictional, ultrasonic, fusion or other techniques. The fastening process may include discrete fasteners or utilize press fits or snap fits. The method for attaching the front wall 3 and the rear walls 4 and 19 may also include a fabrication process which creates the front wall 3 and/or the rear walls 4 and 19 as an integral unit with the housing 2. An example of this integral fabrication method is the process of injection molding the housing 2 as one piece with the front wall 3 and/or the rear walls 4 and 19.

Figure 12:
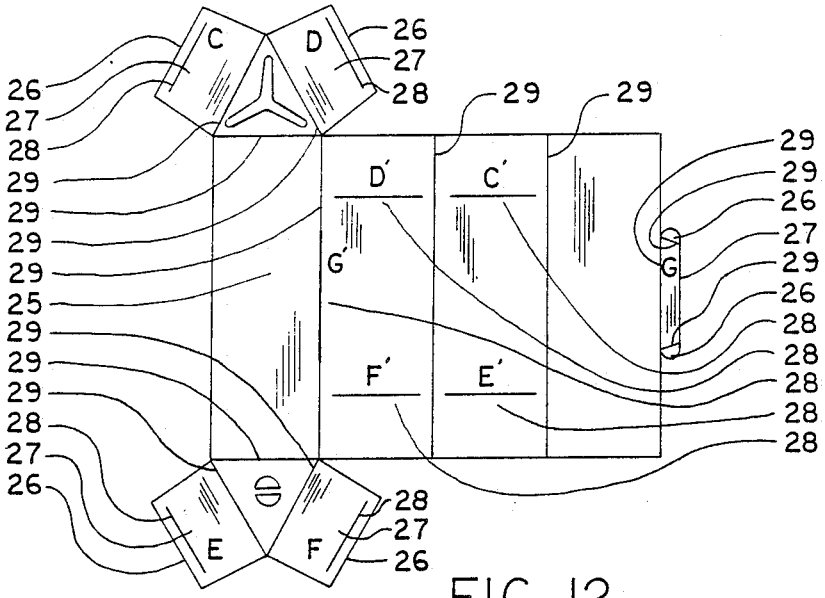
FIG. 12 is plan view of an enclosure assembly pre-cut flat stock outline.
Figure 13:
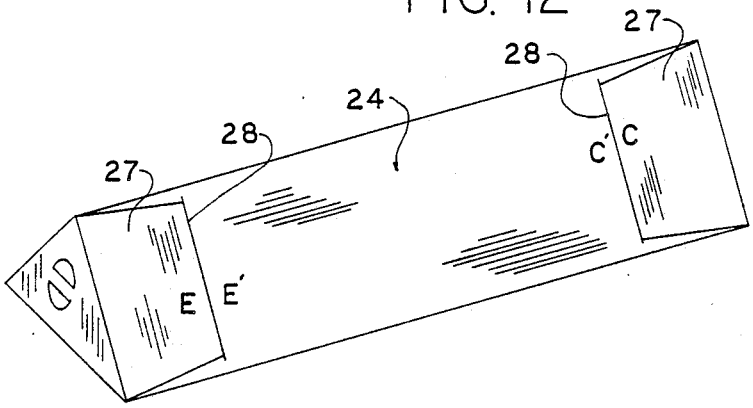
FIG. 13 is a perspective view of an enclosure assembly formed from a folded pre-cut flat stock outline.

Another alternate construction technique is to make a protective enclosure assembly 24, shown in FIG. 13, from a pre-cut flat stock outline 25 with creases 29, and inter latching slots 28, tabs 27 and tangs 26, as shown in FIG. 12. This technique is very similar to how many common cardboard boxes are constructed. The flat stock outline 25 is folded at all the creases 29 and the tangs 26 C, D, E, F and G are formed in such a manner as to be displaced inward, in the assembled condition. The tabs 27 C, D, E, F, and G are inserted respectively into mating slots 28 C', D', E', F' and G'. The tangs 26 of the tabs 27 interlock with the edges of the respective slots 28 C, D, E, F and G and slots 28 C', D', E', F' and G'. In this manner, the final enclosure assembly 24 is formed by folding, latching and/or bonding the precut flat stock outline 25 into it's final configuration. Many variations of folding techniques can be used and many various suitable materials are available for usage, some of which include cardboard, fabric, plastic, and metal.

The available methods for the fabrication and assembly process are not limited to the above mentioned methods and therefor the above mentioned items are not meant to be considered as an all inclusive listing of fabrication, assembly, and attachment techniques.

When fabricating the protective enclosure assembly 1 with the webbed rear wall design, shown in FIG. 1, care must be taken to align the front wall 3 and the rear wall 4 with respect to one another. The alignment of the front opening 14 and rear opening 9 must duplicate the normal alignment of an arrow nock with respect to the fletching on an arrow. This alignment is required so that the arrow nock 5 will approach the rear wall web 10 with proper orientation so that the clip on attachment process of the arrow 8 to the protective enclosure assembly 1 can be easily accomplished. As the arrow 8 is inserted into the protective enclosure assembly 1, this orientation of arrow nock 5 to rear wall web 10 is established by the arrow fletching 6 which slides within the front wall slotted openings 11. Additionally, when removing the arrow 8 from the protective enclosure assembly 1, the alignment of the front wall 3 to the rear wall 4 facilitates alignment of the arrow fletching 6 with respect to the front wall slots 11.

Figure 10:
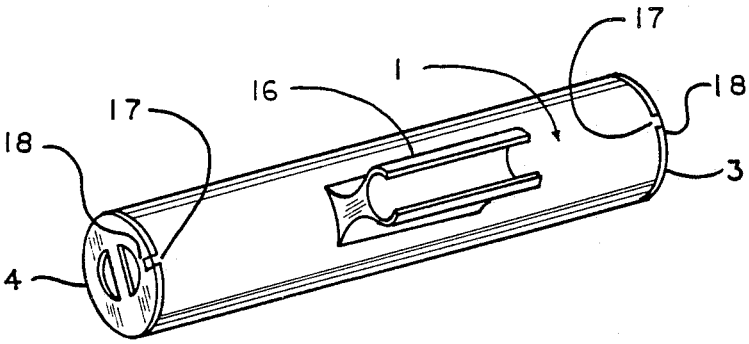
FIG. 10 is a perspective view of an enclosure assembly with a clip attached.

The process of maintaining proper alignment of the front and rear walls 3 and 4, during the manufacturing stage can be aided by designing some keying features 17 and 18, shown in FIG. 10, into the walls 3 and 4, and into the housing 2. The keying features can be a tab 17 on the housing 2, which fits into a slot 18 on either of the walls as shown in FIG. 10. These mating features 17 and 18, assure proper alignment of every manufactured assembly.

When fabricating the enclosure assembly 20 with the press fit receiving chamber design, shown in FIG. 14, no alignment of front to rear wall is required.

In summary, FIG. 1 and FIG. 14 illustrate the arrow 8 attached to the protective enclosure assemblies 1 and 20. The arrow 8 and it's fletching 6 are both centrally and axially positioned with respect to the protective enclosure assembly by either the clipped attachment of the arrow nock 5 onto the web 10 of the rear wall 4 or by the press fit of the arrow nock 5 into the receiving chamber 19. The contact points 12 of the front wall opening 14 also centrally position the arrow shaft 7 within the protective enclosure assembly 1. With the arrow fletching 6 positioned in this manner within the protective enclosure assembly 1 or 20, it is protected from damage.

Figure 9:
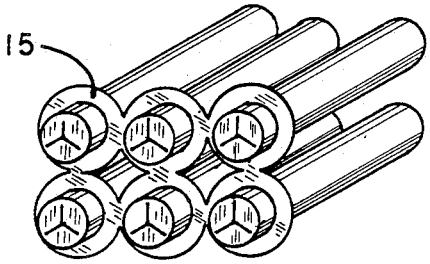
FIG. 9 is a view of a group of enclosure assemblies interconnected with a set of plastic rings.

The protective enclosure assembly can function as a singular unit, or it can be inter connected with other protective enclosure assemblies. Many methods of interconnection can be contrived. One popular interconnection method is to rubber band, elastic band, or plastic band a set of parts together as in FIG. 8. Another commn method of attaching cylindrical objects together is with a set of plastic rings which are formed from one sheet of plastic 15, as shown in FIG. 9. This ring attachment method is very commonly used to interconnect beverage products.

Figure 11:
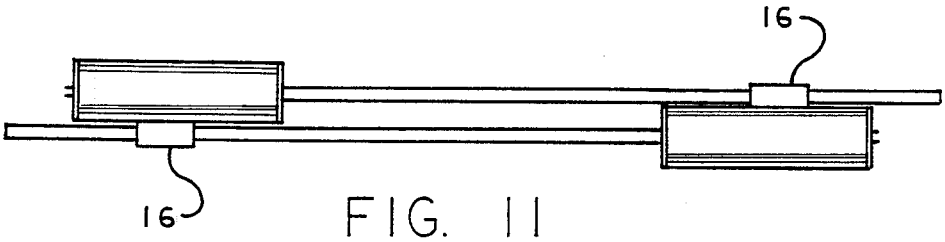
FIG. 11 is a side view of two enclosure assemblies with clips attached to two arrows.

A convenient clip 16, shown in FIG. 10, could also be molded or attached to the side of the protective enclosure assembly 1. This clip 16 could snap fit or clip onto the shaft or another arrow as shown in FIG. 11. The above mentioned clips, rings and bands are some interconnection means which can be used to group the arrows together, yielding a very convenient device to enhance arrow storage and transportation.

While the present invention has been disclosed in connection with a preferred embodiment thereof, it should be understood that there may be other embodiments which fall within the spirit and scope of the present invention and that the invention is susceptible to modification, variation, and change without departing from the proper scope or fair meaning of the following claims.

I claim:

1. A protective device for an arrow fletching comprising an enclosure having a front member and a rear member, said enclosure being of a size to encompass the fletching of an arrow;

said front member having an opening extending therethrough and a series of slot like extensions projecting radially outwardly from said opening and through said front member;

each of said extensions being of a size to enable a radially extending element of a fletching of an arrow to pass therethrough;

said central opening forming a means for positioning an arrow shaft within said front member and for entrance of an arrow into said enclosure;

means within said enclosure for attaching an arrow to said enclosure with the arrow fletching within said enclosure and in alignment with said extensions of said opening.

2. The protection device of claim 1 wherein said means for attaching the arrow within said enclosure comprises means for engaging the nock of the arrow.

3. The protective device of claim 1 wherein said means for attaching the arrow within said enclosure is supported by said rear member.

4. The protective device of claim 1 wherein said means for attaching the arrow within said enclosure is mounted substantially centrally along the length of said enclosure.

5. The protective device of claim 1 wherein said means for attaching the arrow comprises means frictionally engageable with the nock of the arrow.

6. The protective device of claim 1 wherein said means for attaching the arrow comprises a web extending transversely of the length of said enclosure and substantially centrally of said rear member and is of a size to be clipped onto by the nock of the arrow received in said device.

7. The protective device of claim 6 wherein said web is defined by means forming a pair of openings in said rear member adjacent said web of a size to enable the split end of the arrow nock to pass transversely through said rear member and clip onto said web.

8. The protective device of claim 6 wherein said web extends transversely of said opening in said front member and is aligned with respect to said radially projecting extensions of said opening in said front member so as to compliment the alignment between the fletching of the arrow and the arrow nock whereby the nock will grip said web with the arrow fletching aligned with said extensions.

9. The protective device of claim 1 wherein said means for attaching said arrow comprises a chamber which frictionally engages the arrow nock and retains the arrow fletching within said enclosure.

10. The protective device of claim 9 wherein said chamber is formed of resilient material.

11. The protective device of claim 9 wherein said chamber is supported by a member tapering toward said chamber and the latter member includes means for guiding the arrow nock lengthwise of said housing into said chamber.

12. The protective device of claim 9 wherein said chamber is supported by said rear member.

13. The protective device of claim 1 wherein said opening in said front member is of a size substantially the same as that of the arrow shaft but less than the size of the arrow nock, and said front member is formed of resilient means whereby the portions of said front member intermediate said extensions are flexible to an amount sufficient to enable entry of said nock through said front member and into said enclosure and thereafter to support the arrow shaft within said front member.

14. The protective device of claim 1 including a resilient clip mounted on said enclosure of a size to resiliently grasp an arrow shaft extending substantially parallel to said enclosure.

15. The protective device of claim 1 wherein said enclosure is formed of a piece of flat stock folded to form said enclosure and said front and rear members.

16. The protective device of claim 1 wherein said enclosure is of an elongated cylindrical shape.

17. The protective device of claim 1 wherein said enclosure has planar external surfaces.

18. The protective device of claim 1 wherein said rear member forms a rear wall of said enclosure.

* * * * *